US010337299B2

(12) United States Patent
Hales et al.

(10) Patent No.: US 10,337,299 B2
(45) Date of Patent: Jul. 2, 2019

(54) PERFORATING APPARATUS AND METHOD HAVING INTERNAL LOAD PATH

(75) Inventors: John H Hales, Frisco, TX (US); Samuel Martinez, Cedar Hill, TX (US); John P. Rodgers, Roanoke, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 603 days.

(21) Appl. No.: 14/367,332

(22) PCT Filed: Mar. 2, 2012

(86) PCT No.: PCT/US2012/027434

§ 371 (c)(1),
(2), (4) Date: Apr. 20, 2015

(87) PCT Pub. No.: WO2013/130092

PCT Pub. Date: Sep. 6, 2013

(65) Prior Publication Data

US 2015/0240607 A1 Aug. 27, 2015

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/11; E21B 43/116; E21B 43/117; E21B 43/1185
See application file for complete search history.

(56) References Cited

U.S. PATENT DOCUMENTS 2,295,634 A * 9/1942 Collins ..... E21B 43/116 175/299
2,517,560 A * 8/1950 Hambly ..... E21B 43/116 175/4.58

(Continued)

FOREIGN PATENT DOCUMENTS

EP 1780374 A1 5/2007

OTHER PUBLICATIONS

International Search Report and Written Opinion dated Nov. 14, 2012 for Application No. PCT/US2012/027434.

*Primary Examiner* — David J Bagnell
*Assistant Examiner* — Jonathan Malikasim
(74) *Attorney, Agent, or Firm* — Chamberlain Hrdlicka

(57) ABSTRACT

A perforating apparatus for a gun string is presented. The apparatus experiences an axial load and potentially a radial load during use. A central charge-carrier supports shaped-charges and substantially bears the axial load on the apparatus during use. The charge-carrier is positioned within an exterior sleeve and the plurality of shaped-charges, upon detonation, perforate the exterior sleeve. The exterior sleeve does not bear a substantial portion of the axial load on the apparatus and can therefore be thinner and cheaper than in prior art assemblies. An annular space can be defined between the charge-carrier and exterior sleeve. The exterior tubular can bear the radial load due to differential pressure in one embodiment. Alternately, the apparatus includes radial support members extending between the charge-carrier and sleeve for transmitting radial load to the charge-carrier. Alternately, the sleeve and charge-carrier abut one another along a substantial portion of the length of the charge-carrier.

13 Claims, 8 Drawing Sheets

(56) References Cited

U.S. PATENT DOCUMENTS 3,589,453 A 6/1971 Venghiattis et al.
4,185,702 A 1/1980 Bullard
5,007,486 A 4/1991 Ricles
5,449,039 A 9/1995 Hartley et al.
5,785,130 A 7/1998 Wesson et al.
6,158,511 A * 12/2000 Wesson ..... E21B 37/08 166/297
6,412,415 B1 * 7/2002 Kothari ..... E21B 43/116 102/312
6,557,636 B2 5/2003 Cernocky et al.
6,675,893 B2 1/2004 Lund
7,195,066 B2 3/2007 Sukup et al.
7,360,587 B2 * 4/2008 Walker ..... E21B 43/1185 166/297
7,753,121 B2 7/2010 Whitsitt et al.
7,828,051 B2 11/2010 Walker
7,934,558 B2 * 5/2011 Hales ..... E21B 43/119 166/297
7,997,353 B2 8/2011 Ochoa
2004/0216633 A1 * 11/2004 Kash ..... E21B 43/117 102/320
2004/0216866 A1 * 11/2004 Barlow ..... E21B 17/042 166/55
2005/0247450 A1 * 11/2005 Ratanasirigulchai ..... E21B 43/117 166/297
2006/0075889 A1 * 4/2006 Walker ..... E21B 43/117 89/1.15
2007/0256826 A1 11/2007 Ceccarelli et al.
2009/0038846 A1 * 2/2009 Walker ..... E21B 43/116 175/4.6
2010/0133004 A1 * 6/2010 Burleson ..... E21B 43/116 175/2
2010/0243323 A1 * 9/2010 McCann ..... E21B 43/1195 175/2
2010/0276136 A1 11/2010 Evans et al.
2010/0300750 A1 * 12/2010 Hales ..... E21B 43/117 175/2
2013/0206385 A1 * 8/2013 Feng ..... E21B 43/117 166/55

* cited by examiner

PERFORATING APPARATUS AND METHOD HAVING INTERNAL LOAD PATH

FIELD OF INVENTION

This invention relates, in general, to an apparatus for perforating subterranean wellbores using shaped-charges and, in particular, to a perforating apparatus for enhanced performance in high pressure and high temperature wellbores.

BACKGROUND OF INVENTION

Without limiting the scope of the present invention, its background will be described with reference to perforating a hydrocarbon bearing subterranean formation with a shaped-charge perforating apparatus, as an example.

After drilling the section of a subterranean wellbore that traverses a hydrocarbon bearing subterranean formation, individual lengths of metal tubulars are typically secured together to form a casing string that is positioned within the wellbore. This casing string increases the integrity of the wellbore and provides a path through which fluids from the formation may be produced to the surface. Conventionally, the casing string is cemented within the wellbore. To produce fluids into the casing string, hydraulic openings or perforations must be made through the casing string, the cement and a distance into the formation.

Typically, these perforations are created by detonating a series of shaped-charges located within one or more perforating guns that are deployed within the casing string to a position adjacent to the desired formation Conventionally, the perforating guns are formed from a closed, fluid-tight hollow carrier gun body adapted to be lowered on a wire line or tubing conveyed into the wellbore. Disposed within the hollow carrier gun body is a charge holder that supports and positions the shaped-charges in a selected spatial distribution. The shaped-charges have conically constrained explosive material therein. A detonating cord that is used to detonate the shaped-charges is positioned adjacent to the rear of the shaped-charges. The detonating cord can be activated electronically or mechanically when the perforating gun has been positioned in the wellbore.

In such closed, fluid-tight type gun bodies, the explosive jets produced upon detonation of the shaped-charges penetrate the hollow carrier gun body before penetrating the casing wall of the wellbore and the adjacent formation. To reduce the resistance produced by the hollow carrier gun body and increase the depth of perforation penetration into and the formation, the perforating gun body may be provided with scallops or other radially reduced sections such as bands that leave relatively thin wall portions through which the explosive jets pass. The scallops in the hollow carrier gun body must be positioned in a spatial distribution that corresponds to the spatial distribution of the shaped-charges held within the gun body by the charge holder.

It has been found, however, that the reduction in thickness of the carrier gun body limits the strength of the perforating guns. Thus, to perforate in certain high pressure and high temperature wellbores, perforating guns of a given outer diameter have relatively increased wall thickness. Further, use of a carrier gun body with increased wall thickness reduces the available volume within the carrier gun body which necessitates the use of smaller shaped-charges. Likewise, use of a carrier gun body with a thick wall limits the penetration depth of the perforations into the formation. In either case, the performance of such perforating guns is diminished. Of greater concern, are the cracks that often result in the carrier gun body extending from the perforations in the body caused by the shaped charges during perforation. These cracks have the potential to cause failure of the carrier gun body and even separation from the gun string. Additionally, sharp projections of carrier gun body tend to extend from the outer wall after perforation. These projections can hang-up upon pulling the tool from the hole.

A need has therefore arisen for a perforating apparatus that is operable for use in high pressure and high temperature wellbores that does not require a carrier gun body with increased wall thickness. A need has also arisen for such a perforating apparatus that is operable for use in high pressure and high temperature wellbores that does not require a carrier gun body with reduced scallop depth. Further, a need has arisen for such a perforating apparatus that is operable to achieve enhanced perforating performance in high pressure and high temperature wellbores.

SUMMARY OF THE INVENTION

A perforating apparatus for attaching to a gun string is presented for perforating a subterranean formation having a wellbore extending therethrough. During use, the apparatus is under an axial load in the gun string and may also be under a radial load due to a pressure differential between the wellbore and the interior space of the apparatus. A preferred apparatus includes a charge-carrier supporting a plurality of shaped-charges, the charge-carrier for bearing the axial load on the apparatus during use in the gun string. The charge-carrier is positioned substantially within an interior space defined by an exterior tubular. The plurality of shaped-charges are supported by the charge-carrier and positioned within the exterior tubular such that, upon detonation, the shaped-charges perforate the exterior tubular. An annular space can be defined between the charge-carrier and exterior tubular in one embodiment. In another embodiment the exterior tubular and charge-carrier abut one another along a substantial portion of the length of the charge-carrier. The exterior tubular can bear the radial load due to differential pressure in one embodiment. Alternately, the apparatus includes a plurality of radial support members extending between the charge-carrier and exterior tubular for transmitting the radial load to the charge-carrier. The charge-carrier is preferably substantially tubular, having cavities defined therein for supporting the plurality of charges. A detonation cord can be attached to each of the shaped-charges and wrapped around the outer surface of the charge-carrier, disposed in a groove in the outer surface of the charge-carrier or in a bore through the charge-carrier.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
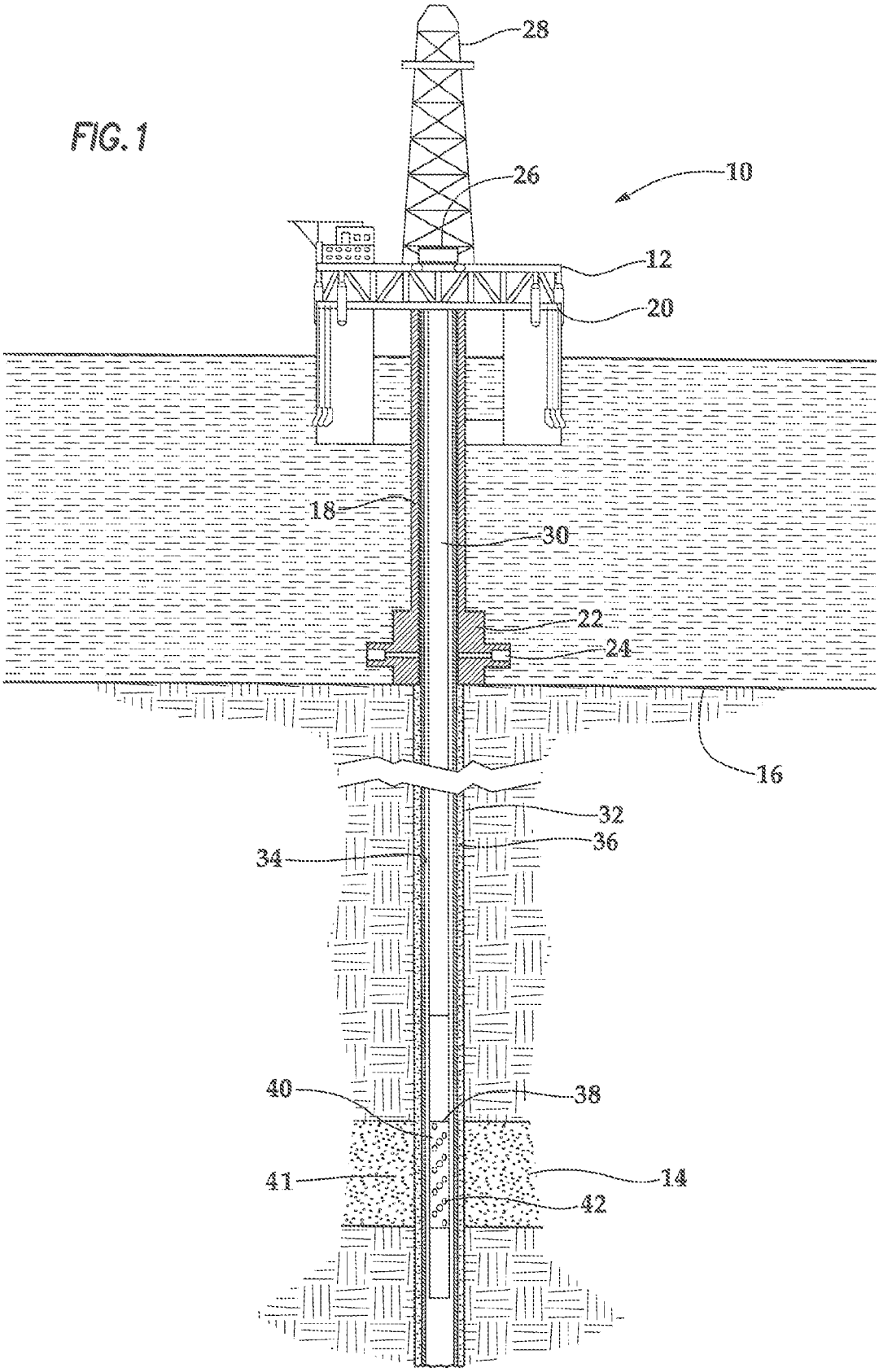
FIG. 1 is a schematic illustration of an offshore oil and gas platform operating a perforating apparatus according to an embodiment of the present invention.

Referring to FIG. 1, a perforating apparatus operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Gun string 30 includes various tools including shaped-charge perforating apparatus 38 that is operable to enhance perforating performance in high pressure and high temperature wellbores. When it is desired to perforate formation 14, gun string 30 is lowered through casing 34 until shaped-charge perforating apparatus 38 is positioned adjacent to formation 14. Thereafter, shaped-charge perforating apparatus 38 is "fired" by detonating the shaped-charges that are disposed within the exterior tubular 40 of the shaped-charge perforating apparatus 38. If preferred, aligned recesses or scallops 42 are formed in the outer surface 41 of the exterior tubular 40. Upon detonation, the liners of the shaped-charges form jets that pass through the exterior tubular and form a spaced series of perforations extending outwardly through casing 34, cement 36 and into formation 14.

Even though FIG. 1 depicts a vertical well, it should be understood by those skilled in the art that the shaped-charge perforating apparatus of the present invention is equally well-suited for use in wells having other configurations including deviated wells, inclined wells, horizontal wells, multilateral wells and the like. Accordingly, use of directional terms such as "above", "below", "upper", "lower" and the like are used for convenience in referring to the illustrations. Also, even though FIG. 1 depicts an offshore operation, it should be understood by those skilled in the art that the shaped-charge perforating apparatus of the present invention is equally well-suited for use in onshore operations.

Figure 2:
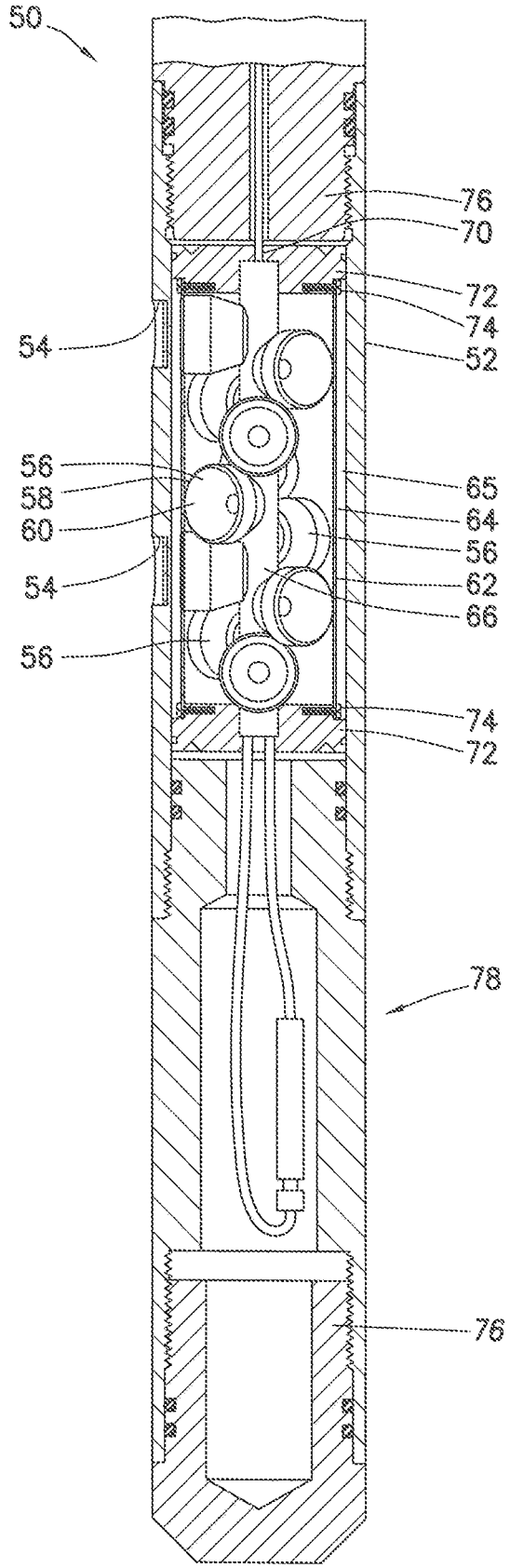
FIG.2 (PRIOR ART)
FIG. 2 is partial cut away view of a prior art perforating apparatus.

Referring now to FIG. 2, therein is depicted a typical prior art shaped-charge perforating apparatus generally designated 50. Perforating apparatus 50 includes a carrier gun body 52 made of a cylindrical sleeve and typically having a plurality of scallops or recesses 54. Radially aligned with each of the recesses 54 is a respective, one of a plurality of shaped-charges 56. Each of the shaped-charges 56 includes a charge case, such as charge case 58, and a liner, such as liner 60. Disposed between each housing and liner is a quantity of high explosive.

The shaped-charges 56 are retained within carrier gun body 52 by a charge holder 62 which includes an outer charge holder tube 64, an inner charge holder tube 66. In this configuration, outer tube 64 supports the discharge ends of shaped-charges 56, while inner tube 66 supports the initiation ends of shaped-charges 56. It is also known to use a single tube charge holder to carry the shaped-charges.

Disposed within inner tube 66 is a detonator cord 70, such as a Primacord (trademark), which is used to detonate shaped-charges 56. In the illustrated embodiment, the initiation ends of shaped-charges 56 extend across the central longitudinal axis of perforating apparatus 50 allowing detonator cord 70 to connect to the high explosive within shaped-charges 56 through an aperture defined at the apex of the housings of shaped-charges 56. It is also known to use relatively larger sized shaped-charges, some of which can extend across substantially the inner diameter of the carrier gun body.

Each of the shaped-charges 56 is longitudinally and radially aligned with one of the recesses 54 in carrier gun body 52 when perforating apparatus 50 is fully assembled. In the illustrated embodiment, shaped-charges 56 are arranged in a spiral pattern such that each shaped-charge 56 is disposed on its own level or height and is to be individually detonated so that only one shaped-charge is fired at a time. It should be understood by those skilled in the art, however, that alternate arrangements of shaped-charges may be used, including cluster type designs wherein more than one shaped-charge is at the same level and is detonated at the same time, without departing from the principles of the present invention.

Perforating apparatus 50 may include one or more longitudinal supports 72 for supporting the charge holder 62 in the carrier gun body 52. The longitudinal supports 72 are attached to the charge holder by screws or similar fasteners 74. The prior art includes various methods and mechanism for mounting the charge holder within the carrier gun body, including rotatably mounted charge holders on roller bearings. See, for example, U.S. Patent Application Publication 2010/0300750 to Hales, which is incorporated herein by reference for all purposes.

An annular space 65 is defined between the carrier gun body and the outermost surface of the charge holder 62. Additional space may be defined within the charge holder 62. This space is often referred to as the free volume of the perforating apparatus. The free volume can be reduced by placement of filler material, such as sand or beads. Some shaped-charges are designed to operate at a selected free volume. It is possible to provide an internal pressure in the carrier gun body that is higher (or lower) than atmospheric pressure, although this requires additional assembly or in-use processes and assemblies. Typically the annular space 65 is at atmospheric pressure for ease of assembly. The annular space or free volume is typically sealed such that wellbore fluid cannot invade the volume. The space, therefore, is at a much lower pressure than the environment in the wellbore adjacent the production zone. At depth in the wellbore, the pressure differential between downhole pressure and the atmospheric or other pressure in the annular space or free volume results in a substantial radial load across the carrier gun body.

A detonator head 78 can be positioned at one end of the perforating apparatus, shown schematically in FIG. 2. One or more connectors 76 may be to connect the perforating apparatus to a gun string, such as tandems used to couple two guns to each other, a bull plug used to terminate a gun string, a firing head or any other type of device which may be attached to a carrier gun body in a gun string. Gun string as used herein refers to work strings, tubing strings, wire-lines, and similar, for lowering and supporting the perforating apparatus in the wellbore.

The typical prior art shaped-charge perforating apparatus must carry two primary types of load once in use in a downhole location in a wellbore: static and dynamic axial (or tensile) load, due to the weight and movement of the gun string, including upon detonation or when being pulled free upon retrieval; and radial pressure load, due to any differential pressure between the exterior (wellbore) and interior of the carrier gun body. That is, the perforating apparatus must act as a pressure vessel and as a load bearing member. Each of these loads will act on the apparatus through a load path. In FIG. 2, both load types are carried by the carrier gun body 52. The axial load path extends through the upper end connector 76, the carrier gun body 52, the detonator assembly 78 (if present), and lower connector 76 (unless the lower connector terminates the string). The radial load path coincident with the charge holder 62 is a differential pressure across the carrier gun body 57.

Consequently, in prior art devices it is common to have the carrier gun body 52 of relatively substantial thickness to support both or either of the axial and radial loads. Further, the gun body must be made of high yield material, typically steel. The typical charge holder has relatively thin walls since it does not carry either axial or radial load. Upon detonation, the shaped-charges must perforate the thick carrier gun body 52 prior to perforating the targeted zone, resulting in less efficient perforation. Further, such an apparatus has an "expendable" carrier gun body 52, since it is compromised by the effects of the shaped-charges. Further, the detonation of the shaped-charges often results in stress concentration cracks in the carrier gun body which can cause failure upon removing the apparatus from the wellbore. Scallops are typically employed opposite the shaped-charges, including to provide depth so that any sharp edges or projections at the perforations in the carrier gun body will not hang-up the apparatus during run-out. The perforation projections would not be such an issue if the material of the gun body was highly ductile, in which case the projections would merely fold upon contact with the casing upon run-out. However, the gun body load requirements preclude use of such materials. Finally, the energy of the detonation of the charge propagate in all directions. The stiffest path for propagation tends to be along the string axis, and thus the loads which propagate axially up and down the apparatus and along the gun string, tend to be relatively large and may cause damage.

Figure 3A:
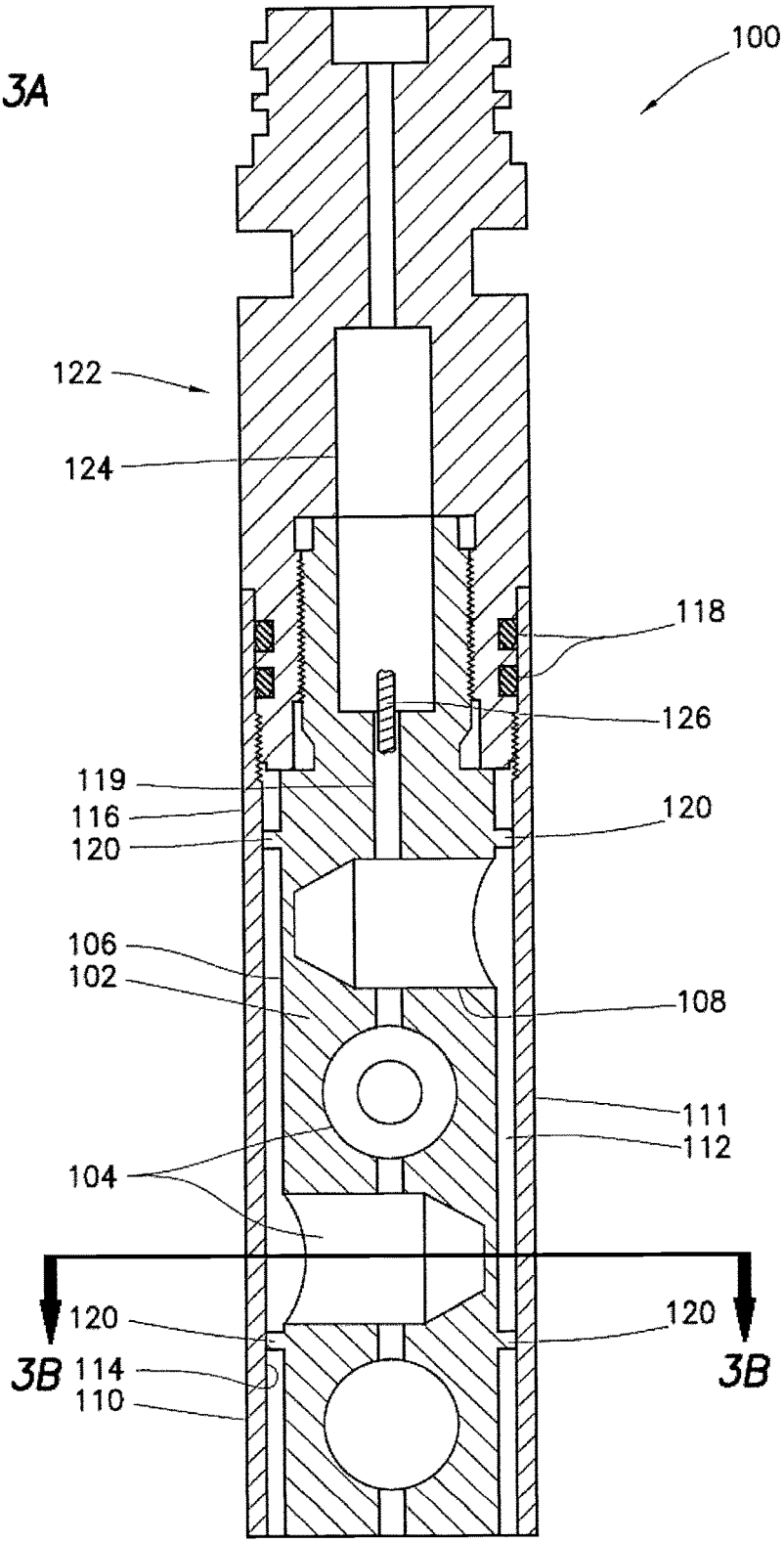
FIG. 3A is an elevational schematic view in partial cross-section of a preferred embodiment of the perforating apparatus of the invention.
Figure 3B:
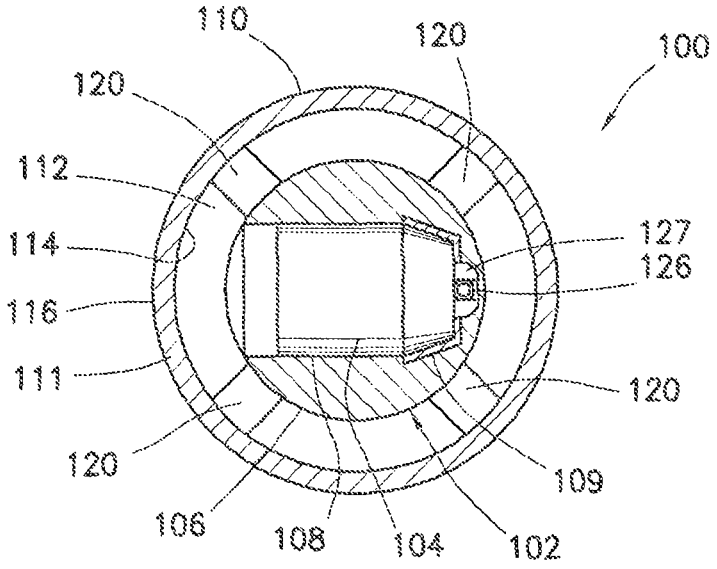
FIG. 3B is a cross-sectional view of the apparatus in FIG. 3A.

FIG. 3A is an elevational schematic view in partial cross-section of a preferred embodiment of the perforating apparatus of the invention; FIG. 3B is a cross-sectional view of the apparatus in FIG. 3A. FIG. 3A shows the upper portion of an exemplary apparatus, the lower portion being substantially the same. Shaped-charge perforating apparatus 100 includes a charge carrier 102 extending longitudinally along the apparatus for supporting a plurality of shaped-charges 104. The charge carrier 102 is shown as substantially cylindrical, with of outer surface 106 defining a cylinder. It is understood that other cross-sectional shapes could be employed without departing from the spirit of the invention. The charge carrier 102 has shaped-charge bores 108 defined therein for placement of the plurality of shaped-charges 104. The bores 108 can be lined with a backing liner 109, seen in FIG. 3B, if desired, such as a high-hardness material or as a "backing" to the shaped-Charge. Preferably the charge carrier 102 is substantially solid in cross-section (except where shaped-charge bores are provided). This allows the charge carrier to support greater loads than is possible with other designs. The charge carrier 102 supports the axial load on the apparatus during use. It is preferably made of metal, such as high strength steel, for supporting the axial load at the temperatures and pressures downhole. In a preferred embodiment, the charge carrier is re-usable and is not destroyed upon detonation of the charges. The charge carrier may have an expected life of a given number of uses. The exterior sleeve is expendable.

The charge carrier 102 is positioned within an exterior tubular or sleeve 110. An annular space 112 is defined between the exterior surface 106 of the charge carrier 102 and the interior surface 114 of the exterior tubular 110. The sleeve 110 also defines an exterior surface 116. The exterior tubular may be connected directly to the charge carrier or, as shown, to a connector 122 at either end of the apparatus. The annular space 112 is sealed against wellbore fluid by seals 118 or other mechanisms known in the art, such as tortuous paths, etc. The annular space 112 is preferably at atmospheric pressure for ease of assembly, although other interior pressures can be employed.

Since the charge-carrier substantially supports the axial load on the apparatus, the exterior tubular 110 can have a relatively thin wall 111. Further, the exterior tubular 110 can be made of relatively lower strength and/or cheaper materials. Such as plastic, aluminum, and other materials. Finally, due to the decreased loads on the exterior tubular, the possibility of lighter or lower strength materials, etc., the exterior tubular is preferably made of a material with a high ductility to prevent damaging debris, to allow perforation projections to easily bend or fold upon contact with the casing or tubing upon run-out, etc. Some materials, such as plastics may simply melt or vaporize upon detonation, leaving little to no debris. Also, the exterior tubular may be made of consumable or frangible materials, such that the tubular "disappears" upon detonation.

In the preferred embodiment at FIG. 3, the exterior tubular 110 is designed to withstand the radial load due to pressure differential across the tubular at depth. The differential pressure is due to the atmospheric (or other) pressure in the free volume of the apparatus compared to the pressure in the wellbore. This creates a radially inward load on the exterior tubular 110. The exterior tubular 110 can be designed to be strong or stiff enough to withstand the radial load on its own. The wall of the exterior tubular can be designed to allow some "flex" under the pressure differential. After detonation, the exterior tubular is expected to be disposed of and not re-usable.

Alternately, the exterior tubular 110 can be supported by one or more radial supports 120. The radial supports 120 can be posts, annular rings, or other members extending from the exterior surface 106 of the charge carrier 102 to the interior surface 114 of the exterior tubular 110. The supports 120 can be formed as a part of the exterior tubular or charge carrier, or can be separate pieces put in place during assembly. The spacing, cross-sectional area, etc., of the supports is selected to provide a radial load path from the exterior tubular to the charge carrier. The supports are provided to support the collapse strength of the exterior tubular. In this way, the charge carrier also bears some or most of the radial pressure load as well as the axial load on the apparatus. The supports may also act as centralizers.

The connector(s) 122 can be tandems for connecting to other shaped-charge perforation apparatus, cross-over tools, detonator subs, tubing sections, wireline apparatus, etc. The connectors 122 can be connected to the exterior tubular and charge carrier by methods known in the art such as threaded connections, pins, rings, collars, etc.

In a preferred embodiment, a detonator assembly 124 is attached to or part of the apparatus 100. The detonator assembly will not be described in detail herein. For further information, see the references incorporated herein. Extending from the detonator assembly is a detonator cord 126 which extends into the apparatus 100 and attaches, typically with clips 127, to the shaped-charges 104. As shown in FIG. 3, a detonator cord passageway 119 can be defined through the charge carrier 102. The cord 126 can be inserted through the passageway and attached to the shaped-charges.

The shaped-charges 104 will not be described in detail herein. The term "shaped-charges" as used herein refers to the entire shape-charge assembly, including charge housing, explosive layers, liners, etc. Further information about shaped-charges, perforation assemblies, etc., can be found in the following references which are hereby incorporated in their entirety for all purposes: U.S. Pat. No. 3,589,453 to Venghiattis, U.S. Pat. No. 4,185,702 to Bullard, U.S. Pat. No. 5,449,039 to Hartley, U.S. Pat. No. 6,557,636 to Cernocky, U.S. Pat. No. 6,675,893 to Lund, U.S. Pat. No. 7,195,066 to Sukup, U.S. Pat. No. 7,360,587 to Walker, U.S. Pat. No. 7,753,121 to Whitsitt, and U.S. Pat. No. 7,997,353 to Ochoa; and U.S. Patent Application Publication Nos. 2007/0256826 to Cecarelli, 2010/0300750 to Hales, and 2010/0276136 to Evans. Various arrangements of shaped-charges may be employed. Similarly, the shaped-charges in FIG. 3 are shown as extending radially across most of the diameter of the charge holder, but other size and configuration of charges may be used.

Figure 4B:
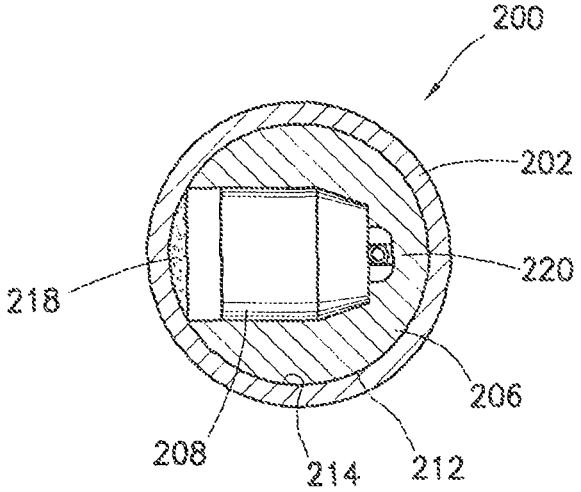
FIG. 4B is a cross-sectional end view of the apparatus in FIG. 4A.
Figure 4A:
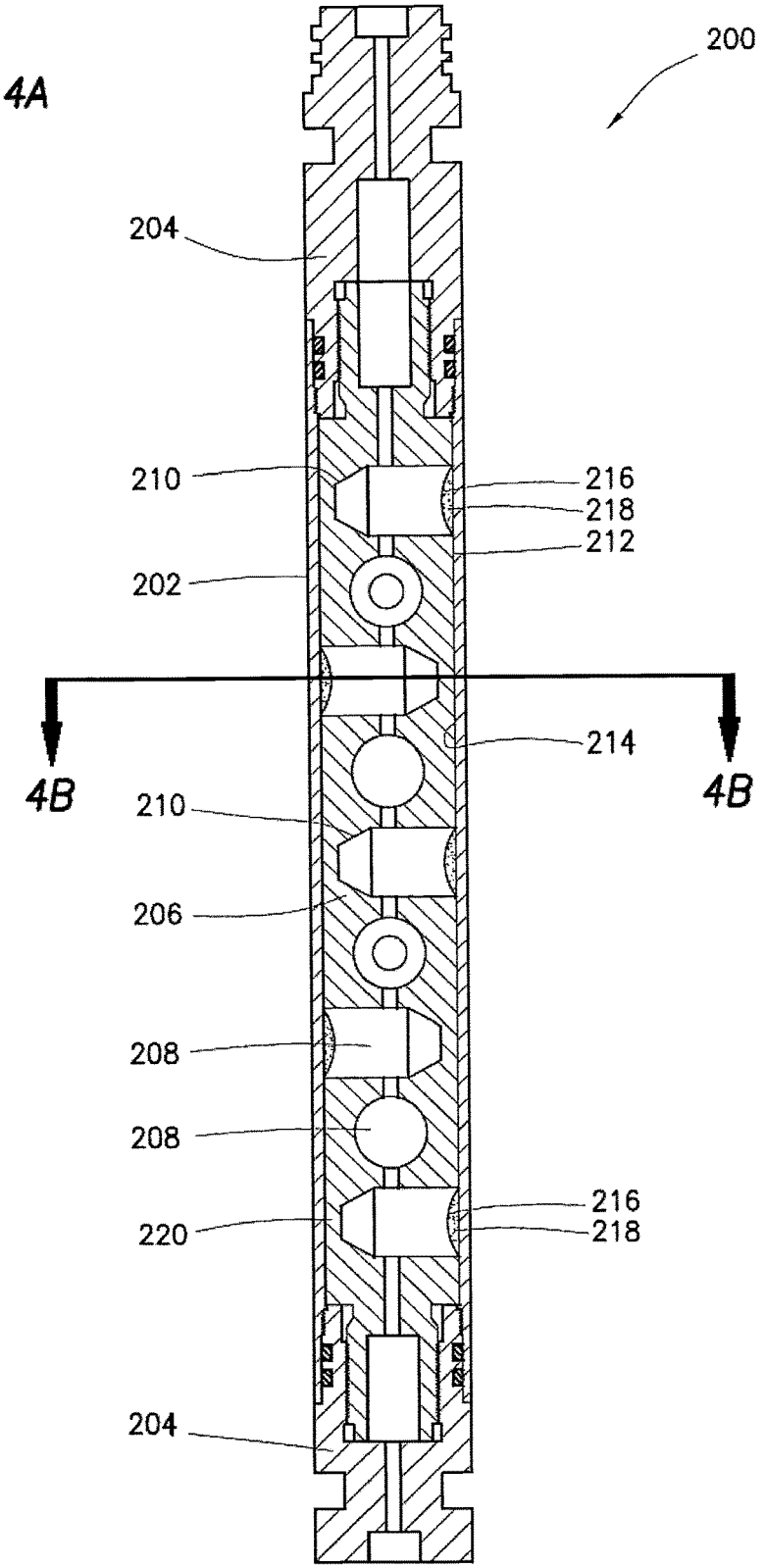
FIG. 4A is an elevational schematic in partial cross-section of a preferred embodiment of the present invention.

FIG. 4A is an elevational schematic in partial cross-section of a preferred embodiment of the present invention; FIG. 4B is a cross-sectional end view of the apparatus in FIG. 4A. The shaped-charge perforator apparatus 200 seen in FIGS. 4A-B is similar to that described in FIGS. 3A-B, and will not be described in detail. The apparatus 200 has an exterior tubular or sleeve 202 attached to connectors 204 and surrounding a charge carrier 206. A plurality of shaped-charges 208 are carried on the charge carrier in bores 210 defined therein. In this embodiment, no annular space is defined between the exterior sleeve and charge carrier. That is, the exterior or outer surface 212 of the charge carrier 206 abuts the inner surface 214 of the sleeve 202. Consequently, radial supports are not necessary and the charge carrier carries the axial and radial loads on the apparatus while in use. If desired, scallop-shaped spaces created between the charge face 216 and the interior surface of the sleeve can be filled with an expendable cap 218.

Also note that the perforation apparatus can be designed to provide a "backing" or detonation support 220 for the shaped-charges. As seen in FIG. 4B, a volume of the charge-carrier can act as the backing or support. The volume, material and/or shape of the support area can be selected and designed to provide support, absorb stress and load, and direct the charge upon detonation. For example, the cavity defined by the charge carrier for the charge can be shaped to direct the shaped-charge. This detonation support 220 can enhance the performance of the shaped-charge or limit potential damage to the apparatus and gun string, for example, by directing the charge upon detonation, absorbing blast energy, etc. As explained elsewhere, the detonation support can include liners, inserts or layers of various material.

Figure 5:
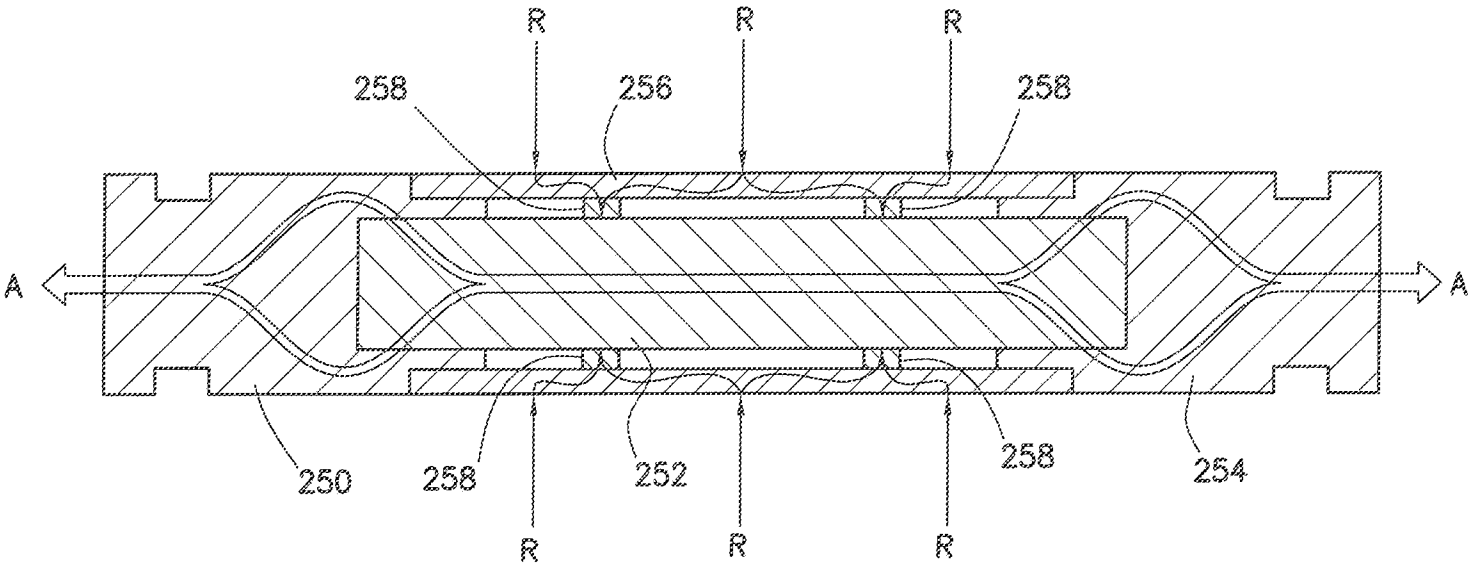
FIG. 5 is a schematic cross-sectional view, simplified, of an exemplary embodiment of the invention illustrating an axial load path and a radial load path through the apparatus.

FIG. 5 is a schematic cross-sectional view, simplified, illustrating the axial load path A and the radial load path R on an exemplary embodiment of the apparatus of the invention. The axial load path A passes through the upper connector 250, the charge carrier 252, and the lower connector 254. No axial load, or only an insubstantial amount, is carried by sleeve 256 in a preferred embodiment. Those of skill in the art will recognize that other members (not shown), such as a detonator sub-assembly, connection rings and devices, etc., may also have the axial load path pass therethrough. The radial load path R, caused by the differential pressure across the sleeve 256, is carried by the sleeve 256 and passes through the radial supports 258 and to the charge carrier 252. The unsupported portions of the sleeve must withstand the radial load and not collapse, but they may undergo flexure during use. In an embodiment as seen in FIG. 4, the support members are unnecessary as the radial load path passes directly from the sleeve to the charge carrier since they are in direct contact.

Figure 6:
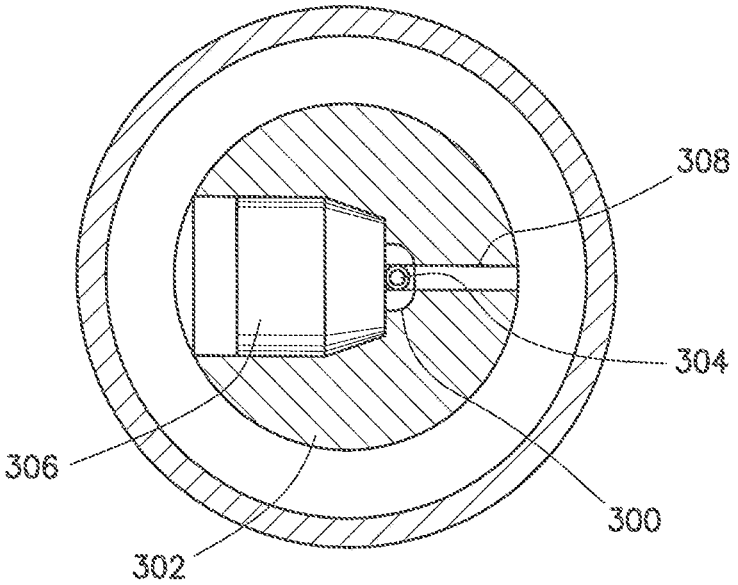
FIG. 6 is a cross-sectional end view of an alternative embodiment of the apparatus of the invention having a detonator cord passageway.
Figure 7:
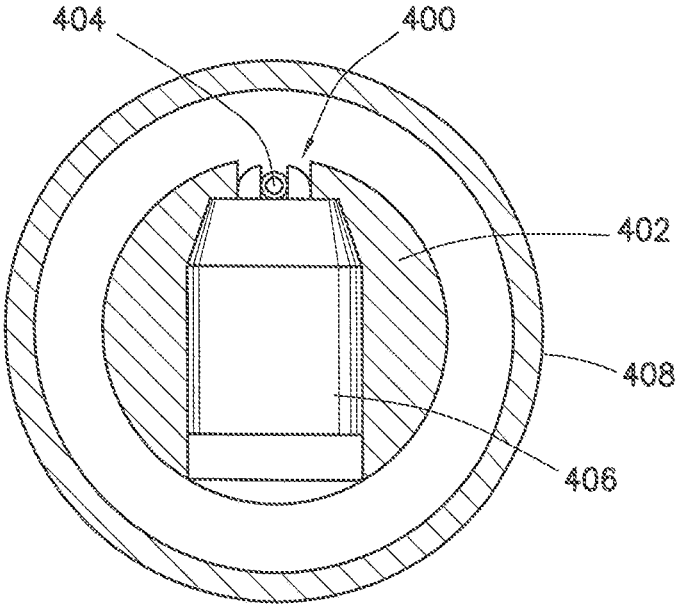
FIG. 7 is a cross-sectional end view of an alternative embodiment of the apparatus of the invention having a detonator cord groove.

FIGS. 6-7 are cross-sectional end views of alternative embodiments of the apparatus of the invention. FIG. 6 shows an embodiment having a detonator cord passageway 300 defined by the charge carrier 302. The detonator cord 304 passes through the passageway 300 and connects to the shaped-charge 306 in a manner known in the art. A "view hole" 308 can be provided to allow a visual confirmation of cord placement, as shown. The passageway 300 is shown as positioned along the charge carrier longitudinal axis. Other positions can be employed.

FIG. 7 shows an embodiment wherein an external detonator cord groove 400 is defined in the charge carrier 402. Detonator cord 404 is shown attached to shaped-charge 406. The detonator cord can be attached to the shaped-charges prior to placement of sleeve 408.

Figure 8:
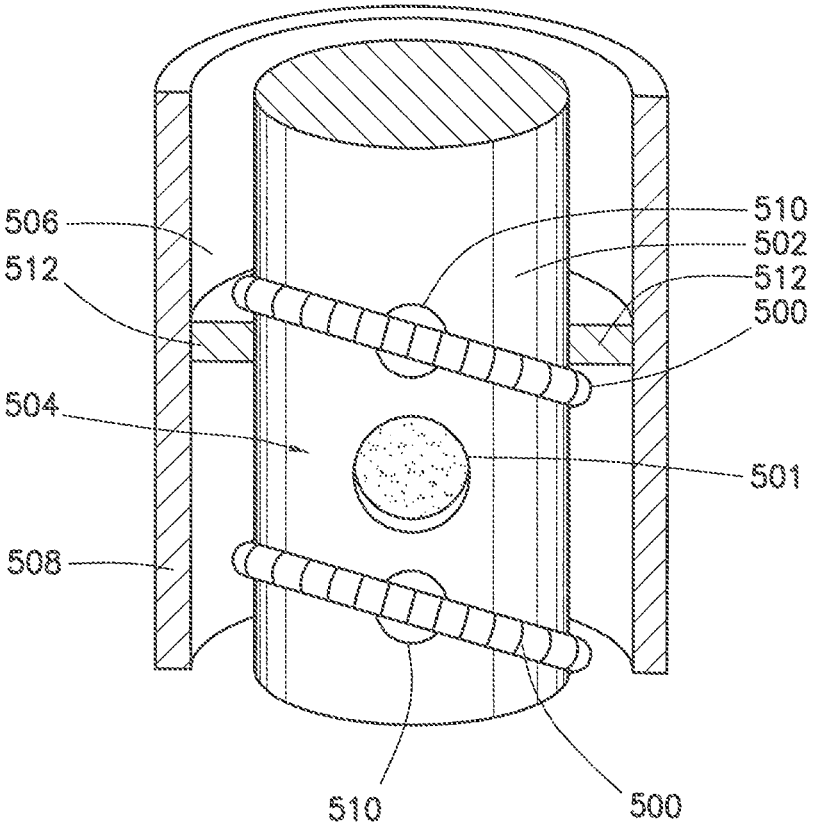
FIG. 8 is a schematic view of an alternative embodiment of the invention having a detonator cord wrapped around the charge carrier.

FIG. 8 is a schematic view of an alternative embodiment of the invention having a detonator cord 500 wrapped around the outer surface 502 of the charge carrier 504 with shaped-charges 501. The cord 500 is positioned in the annular space 506 defined between the charge carrier 504 and sleeve 508 and attaches to the shaped-charges at clip opening 510 defined in the charge carrier. Also seen is an exemplary radial support 512 and centralizer, described elsewhere herein.

It is also possible to have a "pressure balanced" apparatus, wherein the interior spaces of the apparatus and the wellbore pressure are equalized. This results in reducing or eliminating the radial load due to pressure differential. For example, a pressure equalization device can be attached to the apparatus (either in a separate tool in the gun string or as a part of the apparatus). The pressure equalization device contains a pressurized fluid and is operable to release the pressurized fluid into the apparatus interior in a downhole location, or utilizes a piston or similar device to pressurize the interior space of the apparatus, etc. Such devices are known in the art.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A perforating apparatus for attaching to a gun string, the apparatus for perforating a subterranean formation having a wellbore extending therethrough, the apparatus for use under an axial load through the apparatus in the gun string, the apparatus comprising:

an exterior tubular;

a charge-carrier positioned substantially within an interior space defined by the exterior tubular and comprising a plurality of integral radial support members extending from the charge-carrier and contacting the exterior tubular for transferring a radial load from the exterior tubular to the charge-carrier, the charge-carrier for bearing the axial load and the radial load through the apparatus during use in the gun string; and a plurality of shaped-charges supported by the charge-carrier and positioned within the exterior tubular such that, upon detonation, the shaped-charges perforate the exterior tubular.

2. An apparatus as in claim 1, further comprising at least one connector for attaching the apparatus to the gun string.

3. An apparatus as in claim 2, wherein the axial load path through the apparatus is through the at least one connector and the charge-carrier.

4. An apparatus as in claim 1, wherein the plurality of shaped-charges are positioned in a corresponding plurality of bores formed in the charge-carrier.

5. An apparatus as in claim 4, wherein at least one of the plurality of bores for the shaped-charges extends radially into the charge-carrier a distance of at least half the diameter of the charge-carrier.

6. An apparatus as in claim 1, further comprising a detonation cord attached to each of the shaped-charges.

7. An apparatus as in claim 6, wherein the detonation cord is wrapped around the outer surface of the charge-carrier.

8. An apparatus as in claim 7, wherein the detonation cord is disposed in a groove in the outer surface of the charge-carrier.

9. An apparatus as in claim 6, wherein the detonation cord is disposed in a bore through the charge-carrier.

10. An apparatus as in claim 9, further comprising a plurality of radial bores for viewing the detonation cord and its attachment to the shaped-charges.

11. An apparatus as in claim 1, wherein the radial load is due to a pressure differential between the wellbore and an interior space defined in the apparatus.

12. An apparatus as in claim 1, wherein the apparatus is capable of being pressure balanced at a downhole location.

13. An apparatus as in claim 1, wherein the charge-carrier is substantially cylindrical.

* * * * *